US005806783A

United States Patent [19]

Turunen

[11] Patent Number: 5,806,783

[45] Date of Patent: Sep. 15, 1998

[54] METHOD AND DEVICE FOR WINDING A MATERIAL WEB

[75] Inventor: Ismo Turunen, Järvenpää, Finland

[73] Assignee: Valmet Corp., Helsinki, Finland

[21] Appl. No.: 872,290

[22] Filed: Jun. 10, 1997

[30] Foreign Application Priority Data

Jun. 10, 1996 [FI] Finland ..... 962397

[51] Int. Cl.[6] ..... B65H 18/26

[52] U.S. Cl. ..... 242/530.1; 242/541.5; 242/542; 242/547

[58] Field of Search ..... 242/530.1, 541.5, 242/542, 547

[56] References Cited

U.S. PATENT DOCUMENTS

| | | | |
|---|---|---|---|
| 3,237,877 | 3/1966 | Printz et al. | 242/542 |
| 3,501,105 | 3/1970 | Perconti | 242/542 |
| 3,648,342 | 3/1972 | Dorfel | 242/542 |
| 3,692,252 | 9/1972 | Perconti | 242/541.5 |
| 3,837,593 | 9/1974 | Dorfel | 242/542 |
| 3,937,410 | 2/1976 | Justus | 242/530.1 |
| 4,047,676 | 9/1977 | Dahl et al. | 242/541.5 |
| 4,165,843 | 8/1979 | Wedig et al. | 242/541.5 |
| 4,180,216 | 12/1979 | Dahl et al. | 242/541.5 |
| 5,190,235 | 3/1993 | Schonmeier et al. . | |
| 5,320,299 | 6/1994 | Fitzpatrick et al. . | |

FOREIGN PATENT DOCUMENTS 9521118 10/1995 WIPO .

*Primary Examiner*—John P. Darling
*Attorney, Agent, or Firm*—Steinberg & Raskin, P.C.

[57] ABSTRACT

A method and device for winding a material or fibrous web, wherein a number of separate web rolls are formed around separate roll cores placed one after another and side by side, while being supported by support members and loaded by a load of rider rolls in rider roll units in a truncated rider roll unit. During disturbed winding situations when the web roll separate from the winding rolls, the attachment of the rider roll unit/units to the rider roll beam is changed so that the rider rolls load the web rolls that are in a disturbed movement with a load substantially higher than the rider roll load during normal winding.

28 Claims, 5 Drawing Sheets

METHOD AND DEVICE FOR WINDING A MATERIAL WEB

FIELD OF THE INVENTION

The present invention relates to a method for winding a material or fibrous web, wherein a number of separate web rolls are formed around separate roll cores placed one after another and side by side while supported by support members and loaded by rider roll loads produced by the rider rolls in rider roll units in a truncated rider roll unit.

Also, the present invention relates to a device for winding a web in which a number of separate web rolls are formed around separate roll cores placed one after another and side by side while supported by support members and loaded by the rider roll loads produced by the rider rolls in rider roll units in a truncated rider roll unit.

BACKGROUND OF THE INVENTION

Owing to variations in the cross-direction profiles of the web to be wound, such as thickness, moisture, and roughness, the diameters of the adjacent, separate web rolls do not become precisely equally large in spite of the fact that, in principle, exactly equally long component webs are wound onto these separate rolls. As such, owing to the different diameters of the web rolls, the roll cores placed in their centers are displaced in relation to one another during the progress of the winding so that their centers of rotation are separated and, at the same time, minor variation also occurs in the angular speeds of the rolls. However, since the center of the web rolls are in contact with one another during the entire winding process, diverting forces arise between the winding cores and as a result, the rolls tend to "jump" which leads to vibrations, whereby the web rolls that are being formed can be damaged. Owing to this detrimental vibration, in drum winding, it is usually necessary to operate the winding apparatus more slowly, and in the present, one has been content to wind the web at a lower winding speed which unfortunately reduces the capacity of the machine and is, thus, uneconomical.

The problem described above has occurred as long as winders of the drum winder type have been used. The seriousness of the problem has, however, varied in the course of years, because the profile of the web produced in a paper machine has been improved and, at the same time, the roll size and the winding speed have been changed only to a small extent. In the last several years, the diameters of the customer rolls produced have been made ever larger, and at the same time the winding speeds have also become higher, for which reason the problem of vibration of the web rolls caused by the diverting forces arising between the winding cores has been manifested again with greater importance. Even a slight variation in the profile in the direction of width of the web is cumulative, in particular during winding of thin paper grades, so that the flaws of shape in the rolls arising from the variation in the profile of the web produce a significant problem of vibration.

With respect to the prior art, reference is made, e.g., to U.S. Pat. No. 5,320,299. In this prior art arrangement, the regulation of the rider roll load takes place either so that a common volume of hydraulic fluid in the hydraulic loading cylinders is closed and the load is regulated by means of the cylinders in the rider roll beam, or so that the rider roll beam is always at a substantially constant distance from the faces of the web roll and the pressure in the hydraulic loading cylinders is regulated by varying the pressure in the air space in the common container of hydraulic fluid. The arrangements in this patent are concentrated on producing a uniform rider roll load on all the web rolls, and control of the regulation of the position and the regulation of the load in the rider roll system.

It is a persistent problem in the prior art winding methods and devices that, when the web rolls move, the rider roll cannot support the web rolls sufficiently well, and the rider roll does not remain on the web roll faces, i.e., in contact therewith. This problem occurs in almost all prior art arrangements in which an articulated rider roll is supported by pneumatic or hydraulic cylinders.

By means of the prior art arrangements, it is impossible to control the movements of web rolls arising from disturbance in the winding, in particular in the initial stage of the disturbance in which the movements of the web rolls are still small. This stems from the following reasons:

Hydraulic/pneumatic cylinders do not react to very small movements, which are absorbed in the resilience of their seals. The movements of the web rolls occur as very small movements in the truncated rider roll, because the principal movement of the web rolls takes place in the horizontal direction, whereas the rider roll can support them in the vertical direction only. Thus, by means of a typical prior art construction, it is impossible to interfere with disturbing movements of the web rolls right in the initial stage of the movements, but the disturbance can increase freely. The fact that also small web rolls are in contact with a rider roll and a rider roll load has been set for them does not help enough, for this load is still very small in comparison with the weight of the web roll and the friction forces acting at the ends of the roll cores. For example, a typical web roll, whose diameter is 1000 mm and whose width is 1 meter, weighs from about 500 kilograms to about 1000 kilograms, depending on the density of the web roll, whereas a typical rider roll load with this diameter is from about 0.5 kN to about 1.0 kN. The thrust forces at the ends of the roll cores have been measured, for example, as about 25 kN, which, with a friction coefficient of about 0.4 between the roll core ends, provides a force of about 10.0 kN in the radial direction of the roll.

The force of a hydraulic/pneumatic cylinder does not depend on its position, so that, when a jumping web roll raises a truncated rider roll, the rider roll load per roll is not changed. Thus, the situation is even worse than in a rider roll which has long rider rolls fixedly mounted on the rider roll beam: here the forces applied by the web rolls to the rider roll are transferred directly to the massive rider roll beam, in which beam the inertia of its mass increases the rider roll load in a quick disturbing movement of the web roll. In a conventional prior art arrangement, the articulated rider roll units yield resiliently in compliance with the nature of the hydraulic/pneumatic cylinders and their long hose systems for pressure medium.

In a typical prior art arrangement, the suspension of the rider roll units on the rider roll beam has no elastic spring at all, by whose means it would be effectively possible to affect the specific frequency of the rider roll unit, i.e., the frequency of oscillation of the web rolls up to which the rider rolls can follow the disturbing movement of the web roll so that they remain constantly on the face of the web roll.

OBJECTS AND SUMMARY OF THE INVENTION

It is an object of the present invention to provide an improvement over the prior art winding methods and apparatus.

It is a further object of the invention to provide a device intended for situations in which disturbance of web rolls arises, which device can react to quick and very small disturbances in the winding process.

In the method in accordance with the invention, if the winding of the web rolls is disturbed, the attachment of the rider roll unit/units to the rider roll beam is changed so that the rider rolls load the web rolls that are in a disturbed winding movement with a load substantially higher than the rider roll load during normal winding.

The device in accordance with the invention includes means for attenuating a disturbed movement of the web rolls and for changing the attachment of the rider roll unit/units to the rider roll beam so that the rider rolls are structured to load the rolls that are in a disturbed movement with a load substantially higher than the rider roll load during normal winding.

In the present invention, it has been realized to provide a force considerably higher than a normal rider roll load to attenuate disturbed movements of the web rolls. To this end, in the invention, the forces are transferred from the rider roll unit to the rider roll beam.

In a preferred embodiment of the invention, a separate coupling is employed between the rider roll unit and the rider roll beam, this coupling being engaged irrespective of the position of the rider roll unit and exclusively when disturbed movements occur in the web rolls, in which connection the rider roll unit can be positioned at an arbitrary distance from the rider roll beam.

The movements of a rider roll unit produced by normal winding are characterized by slowness of the movement (the diameter of the web rolls changes as the winding makes progress) compared with the high speed of the disturbed movements (vibration of web rolls, jumping, etc.). The speed of the movement of setting of rider rolls on the web rolls is, for example, about 1.2 mm per second when a difference of about 20 mm is produced in the roll diameters as the web rolls grow from a diameter of about 500 mm to a diameter of about 800 mm at a running speed of about 2500 meters per minute and when the thickness of the paper is about 0.1 mm. Similarly, if the web rolls produce a sinusoidal-shaped disturbed movement in the rider roll, in which movement the amplitude from peak to peak is about 0.7 mm and the frequency is about 8 cycles per second, the maximal speed of this movement is about 35 mm per second.

The connection with the rider roll beam can be rigid, in principle, but if a spring is added between the coupling and the rider roll beam, the following advantages are obtained:

1) The dynamic speed of the truncated rider roll can be brought to the desired level by means of different rigidities of the spring, i.e., the rider rolls can be made to remain constantly on the faces of the web rolls.
2) The force opposed to the movements of the web rolls can be regulated so that the movements remain as small as desired, and deformations do not arise in the web rolls, or no other disturbance except that arising from an excessive momentary nip force is produced in the web rolls, in which connection an extreme case would be a web break.

In a coupling for rapid movement, it is possible to utilize, for example, resistance to fluid flow (hydrodynamic coupling), a coupling controlled by an acceleration detector, or a coupling that utilizes the inertia of mass, etc. The operation of a hydrodynamic coupling is such that the coupling operates right from the beginning of the disturbed movement and, thus, differs from the construction and from the principle of operation of a conventional shock absorber.

One indicator of engagement of the coupling can also be the direction of movement, in which case engagement of the coupling takes place exclusively in connection with an upwards movement of the truncated rider rolls (e.g., self-activating friction).

Accordingly, in one specific embodiment of the method in winding of a material web in accordance with the invention, at least one rider roll is mounted on a rider roll beam, and the coupling between the rider roll(s) and the rider roll beam is adjusted in a situation of disturbed winding when the respective web roll separates from the support members in comparison to a normal winding situation when the respective web roll is in contact with the support members. In this manner, the load produced by the rider roll(s) is higher during disturbed winding than the load produced by the rider roll(s) during normal winding. More particularly, the acceleration of the rider roll beam may be measured and a signal generated based on the measured acceleration of the rider roll beam, the coupling of the rider roll(s) to the rider roll beam being adjusted based on the signal. The acceleration of the rider roll beam may be measured in a direction opposite to the direction of the load produced by the rider roll(s). In certain embodiments, the coupling between the rider roll(s) and the rider roll beam may be adjusted based on flow resistance of a fluid, inertia of mass of the rider roll(s), or the direction of movement of the rider roll(s).

The device in winding of a material web in accordance with the invention comprises attenuation means for attenuating a disturbed movement of at least one of the web rolls when the web roll(s) separates from the support members. The attenuation means comprise means for adjusting the coupling of at least one rider roll loading that web roll during the disturbed movement such that the load produced by the rider roll(s) during the disturbed movement is higher than the load produced thereby during normal winding when the respective web roll is in contact with the support members. The device may include a fastening bracket connected to the rider roll beam, and a fastening member connected to each rider roll, in which case, the coupling adjustment means comprise a coupling extending between the fastening bracket and the fastening member connected to each rider roll. The coupling may comprise: 1) biasing means fixed to the fastening bracket; 2) means defining an interior compartment receivable of a pressure medium, a piston movable within the interior compartment and at least one narrow flow passage formed in the piston through which the pressure medium is flowable; and/or 3) an outer peripheral wall defining an interior compartment receivable of a pressure medium, a piston movable within the interior compartment and at least one narrow flow passage formed in the peripheral wall and through which the pressure medium is flowable.

In another embodiment, the load of the web rolls may be produced by at least one cylinder actuated by a pressure medium and the coupling adjusting means comprise an acceleration detector for detecting acceleration of the rider roll beam and generating a signal representative thereof, means for regulating the flow of the pressure medium to the cylinder(s), and a regulator for receiving the signal representative of the acceleration of the rider roll beam from the acceleration detector and controlling the regulating means based thereon. The regulating means may comprise a valve which ceases the flow of pressure medium into the cylinder. The acceleration detector may be arranged to control a disk brake, a coupling based on friction, or any other, equivalent coupling actuator.

The invention will be described in detail with reference to some preferred embodiments of the invention illustrated in the figures in the accompanying drawing. However, the invention is not confined to the illustrated embodiments alone.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1:
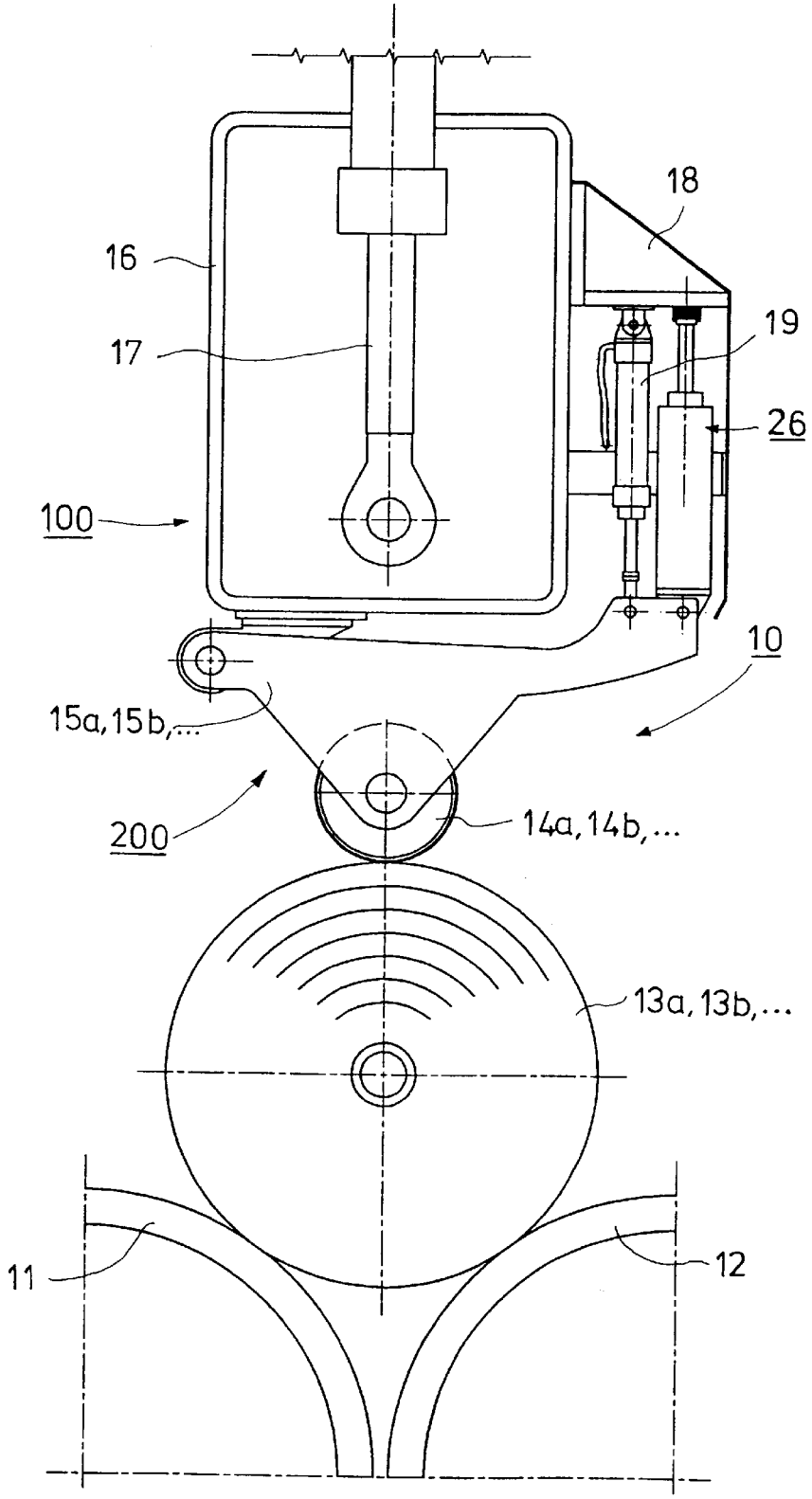
FIG. 1 is a schematic side view of a preferred embodiment of the method and the device in accordance with the invention.
Figure 2:
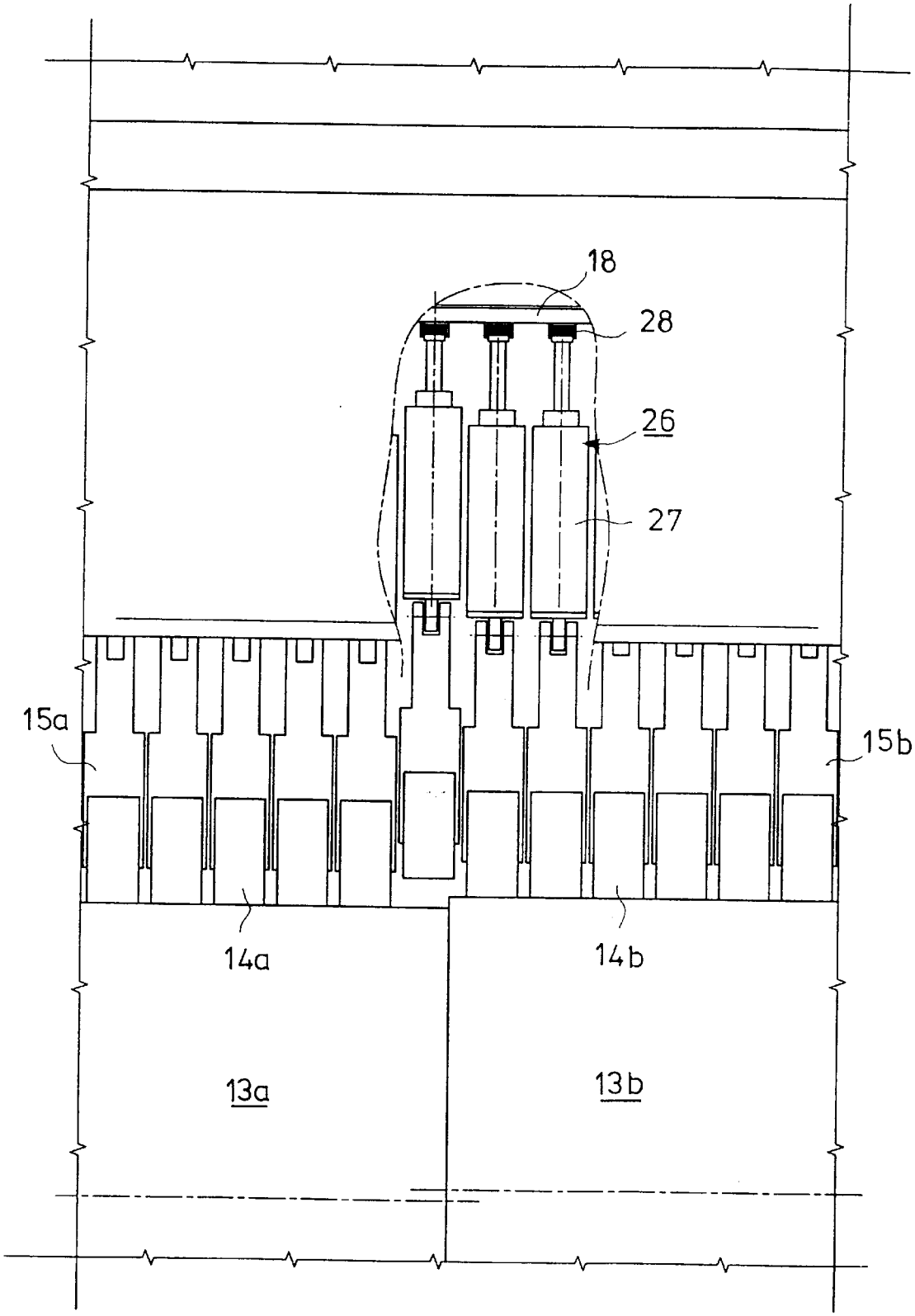
FIG. 2 is a front view of the embodiment shown in FIG. 1.

Referring to FIGS. 1–6 wherein like reference numerals refer to the same or similar elements, in FIG. 1, the drum winder is denoted generally by reference numeral 10. The drum winder 10 comprises the winding drums 11 and 12. The web rolls to be wound are denoted by reference numerals 13*a*, 13*b*, etc. (all of which are not shown since they extend in a direction into the sheet of paper alongside one another). Rider rolls 14*a*, 14*b*, etc. are attached to a respective fastening brackets 15*a*, 15*b*, etc. (FIG. 2). Cylinders 19 regulate the load on a respective one of the rider rolls and are attached from one end to one of the fastening brackets 15*a*, 15*b*, etc. and from the other end to a fastening bracket 18. The cylinders that displace a rider roll beam 16 that loads the rider rolls are denoted by reference numeral 17. In FIG. 1, a truncated rider roll, which comprises the rider roll beam 16 and a number of rider roll units 200, is denoted generally by reference numeral 100. Reference numeral 200 refers generally to the rider roll unit, each of which comprises one of the rider rolls 14*a*, 14*b*, etc. as well as a respective one of the fastening bracket 15*a*,15*b*, etc.

Figure 3:
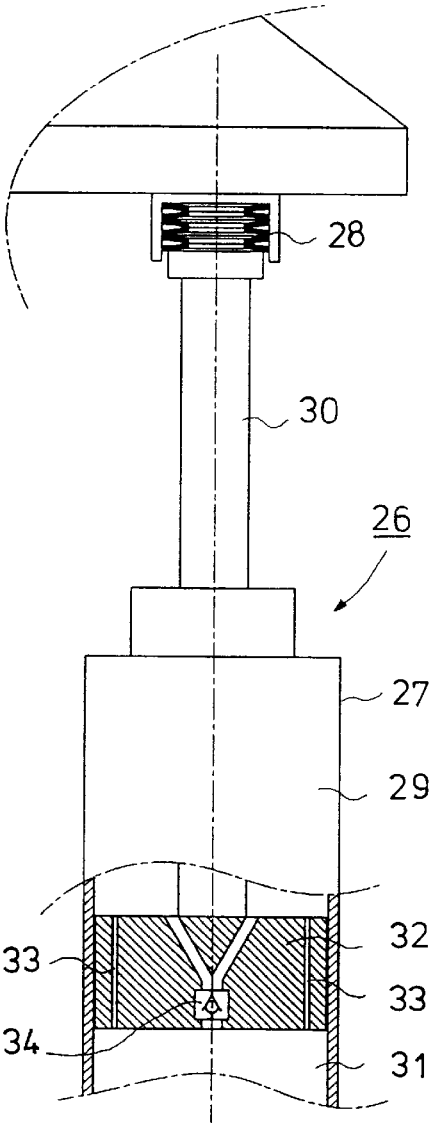
FIG. 3 shows a detail of FIG. 2 on an enlarged scale partly in section.

In the embodiment shown in FIGS. 1–3, the device for use during disturbances in the winding of the web onto the web rolls 13*a*, 13*b*, i.e., disturbing situations, is denoted generally by reference numeral 26. The device 26 comprises a hydrodynamic coupling 27 and a spring device 28. The hydrodynamic coupling includes a cylinder 29, a piston rod 30, and a chamber 31 in an interior thereof. Narrow flow passages 33 are formed into a head block 32 of the piston 30. A return valve is denoted by reference numeral 34. The hydrodynamic coupling 27 operates as follows to alter the attachment of the rider roll unit 200 to the rider roll beam 16. During normal winding of the web onto web rolls 13*a*, 13*b*, . . . , the winding proceeds undisturbed, and the load regulation cylinder 19 takes care of the rider roll load (the hydrodynamic coupling 27 is not active so that the rider roll unit 200 is in a first attachment position in relation to the rider roll beam 16). When a disturbed movement takes place in the web roll, which raises the rider rolls placed at the web roll/rolls concerned, the coupling 27 is "locked" and the movement of the rider roll is transferred to the spring 28, which is pressed and compressed. In this situation, the hydrodynamic coupling 27 is "active" so that the attachment of the rider roll unit 200 to the rider roll beam 16 has changed, i.e., the rider roll unit 200 is in a second attachment position in relation to the rider roll beam 16 in view of its connection through both the cylinders 19 and the active hydrodynamic coupling 27. The compression of the spring 28 results in the load of the rider roll being increased in compliance with the properties of the selected spring. When the web roll returns downward, the compressed spring 28 returns the rider roll down equally as quick by means of the coupling 27, which is still locked. The spring device 28 can be, for example, a pack of cup springs or a spiral spring fitted around the piston rod 30.

By means of the arrangement shown in FIGS. 1–3, the rider roll load can be increased, e.g., for a web roll whose diameter is about 1000 mm, width about one meter and weight from about 500 kilograms to about 1000 kilograms, depending on the density of the web roll, to a value of, e.g., about 20 kN after the web roll has raised the rider roll by about 1.0 mm.

Thus, in FIG. 3, just one preferred embodiment of the construction of the coupling 27 is shown. Engagement of the coupling is based on an increased flow resistance with a change in speed, i.e., the cylinder fluid flows with almost no resistance also in narrow ducts or flow passages 33 through the head block 32 of the piston 30 upon slow movements of the rider roll. In rapid movements, practically no flow can occur through the passages 33, and forces are transferred from one part of the hydrodynamic coupling 27 to another part. On the other hand, with slow movement, the hydraulic fluid flowing in the hydrodynamic coupling 27 has time to flow through the passages 33 and there is no rigid coupling between the parts.

Figure 4:
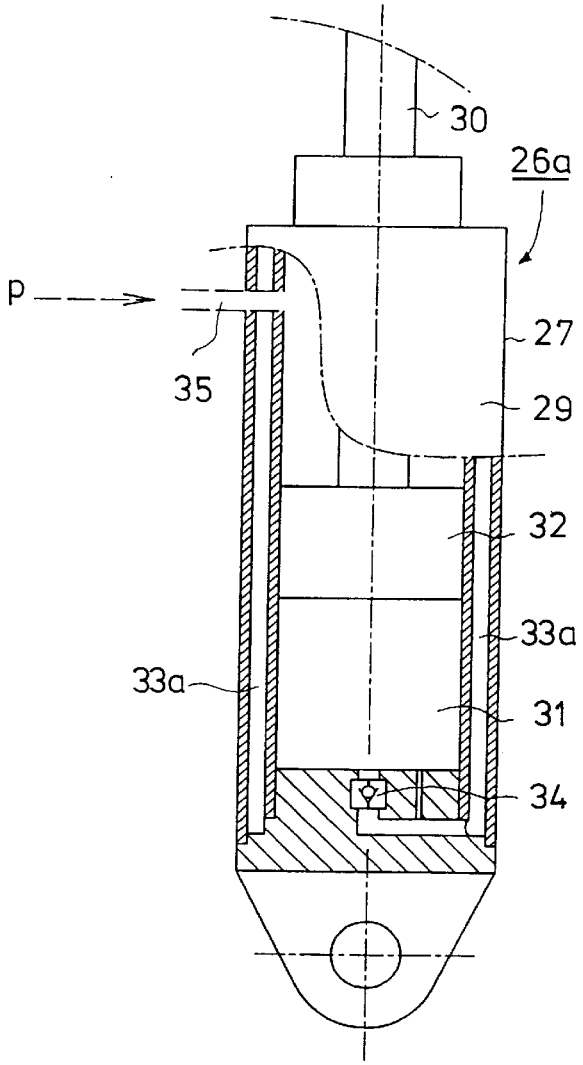
FIG. 4 shows a second preferred embodiment of the detail shown in FIG. 2 on an enlarged scale and partly in section.

In the embodiment shown in FIG. 4, the device for alleviating disturbance situations of the web rolls 13*a*, 13*b* is denoted generally by reference numeral 26*a*. In this embodiment, the hydrodynamic coupling 27 is accomplished in a manner slightly different from the hydrodynamic coupling 27 shown in FIG. 3. In the embodiment of FIG. 4, the flow ducts 33*a* are formed into the structure of the cylinder 29, e.g., within an outer peripheral region of the cylinder 29. It is also possible to use this construction as a load regulation cylinder by passing a pressure p in the cylinder 29 along a duct 35 illustrated by the dashed lines.

The embodiment shown in FIG. 4 permits the operation of the construction as a coupling 27 also without a piston 32. This permits minimizing of the friction to a level as low as possible.

Figure 5A:
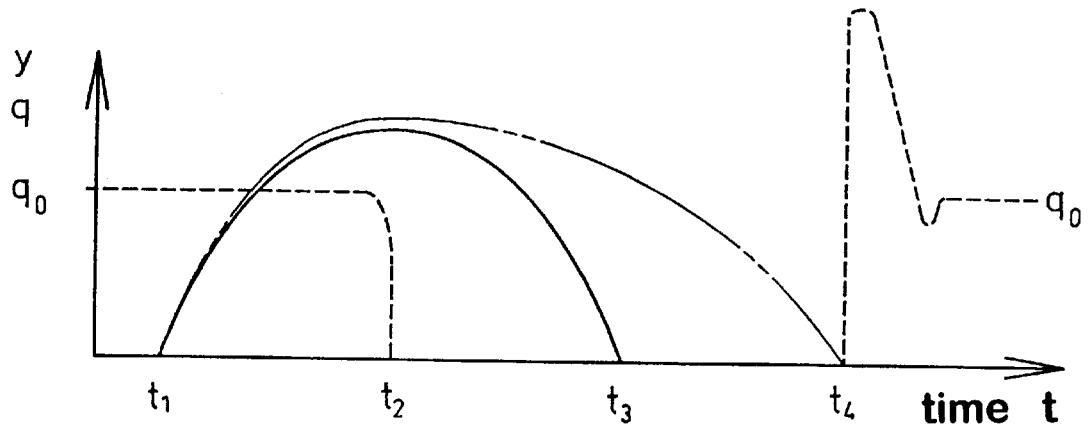
FIG. 5A illustrates the movement of the web roll and the rider roll load in a prior art winder as a function of time.
Figure 5B:
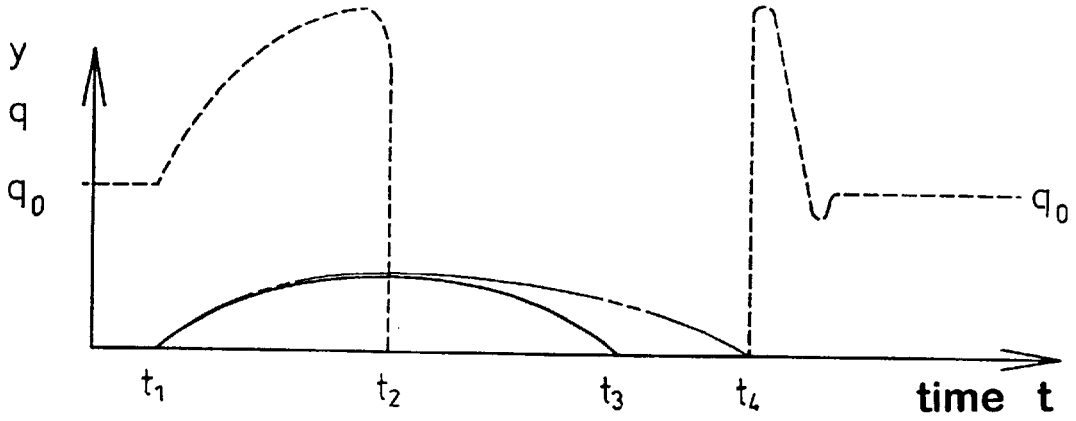
FIG. 5B illustrates the movement of the web roll and the rider roll load in a preferred embodiment of a winder in accordance with the invention as a function of time.
Figure 5C:
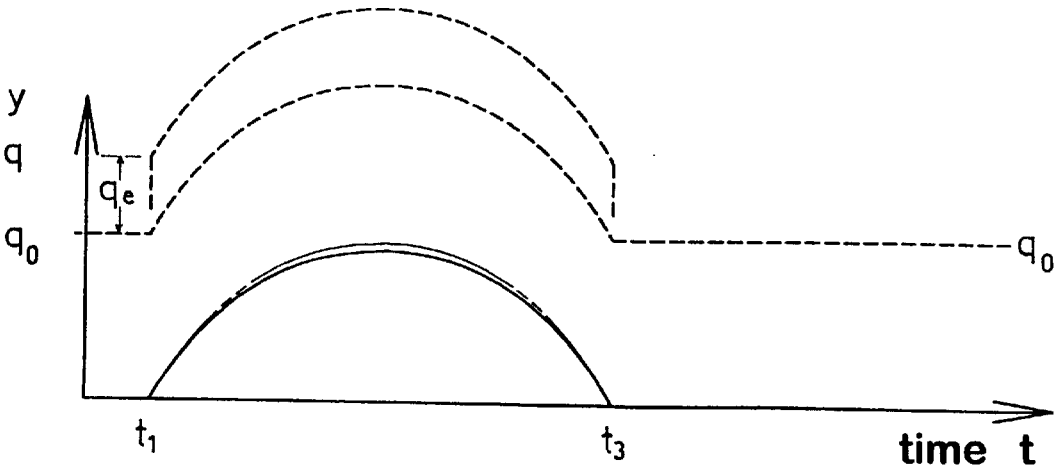
FIG. 5C illustrates the movement of the web roll and the rider roll load in a second preferred embodiment of a winder in accordance with the invention as a function of time.

FIGS. 5A, 5B and 5C illustrate the conduct of a prior art rider roll arrangement and rider roll arrangement of two different embodiments of the invention in a case in which, out of one reason or another, the web roll jumps up once from the winding bed along the face of one of the winding drums and returns down. The y-movement of the web roll 13*a*,13*b*, etc. illustrated in FIGS. 5A, 5B and 5C is illustrated by a solid line. The change in the rider roll load q is illustrated by a dashed line. The movement of the rider roll is illustrated by a dashed-dotted line. At the time $t_1$, the web roll starts rising, at the time $t_2$, it is at its highest point, and at the time $t_3$, the web roll has come down.

FIG. 5A illustrates a prior art construction, in which the rider rolls are supported on the rider roll beam by means of pneumatic or hydraulic cylinders. For the sake of clarity of illustration, the movement of the rider roll, illustrated by the dashed-dotted line, during the time $t_1, \ldots, t_2$ has been drawn slightly above the curve that illustrates the movement of the web roll. The rider roll follows the movement of the web roll during the time $t_1, \ldots, t_2$, but, since the construction is dynamically slow, the rider roll does not have sufficient time to follow the movement of the web roll, and it is separated from the web roll face at the time $t_2$, when the web roll starts moving downward. The rider roll again meets the roll face at the time $t_4$. Since the cylinder force does not depend on the position of the piston, the rider roll load q is not changed from its set value $q_0$ when the web roll rises. When the rider roll is separated from the web roll face at the time $t_2$, the rider roll load q falls down to zero. Similarly, at the time $t_4$, the rider roll load q rises momentarily to a very high level, and is finally set at its set value $q_0$.

FIG. 5B illustrates the operation of a rider roll when a hydrodynamic coupling is added to the rider roll unit between the rider roll unit and the rider roll beam. Also as shown in FIG. 5B, the rider roll is separated from the web roll face at the time $t_2$ and returns onto the web roll face at the time $t_4$, but the rider roll load q starts increasing directly as the web roll rises since the forces applied to the rider roll are transferred directly to the massive rider roll beam 16. For this reason, the movement of the web roll in the direction y remains shorter than in the case of a rider roll without a coupling. However, the rider rolls are separated from the web roll face at the time $t_2$, because now also the massive rider roll beam 16 is involved in the movement.

FIG. 5C illustrates a situation in which a spring device has been added between the hydrodynamic coupling and the rider roll beam. In this situation, the rider roll remains on the face of the web roll because the spring device provides the rider roll with a sufficient dynamic speed (increases the specific frequency). The rider roll load q is changed in accordance with the movement of the rider roll in compliance with the elastic constant of the spring device. Since the rider roll stays on the face of the web roll, there will be no nip force peak which deforms the web roll when the rider roll strikes against the face of the web roll. Further, right after the web roll has come down at the time $t_3$, the rider roll is prepared to counteract a new rise of the web roll.

In FIG. 5C, the lower curve of the movement of the rider roll illustrates a spring that has not been pre-compressed, in which case the rider roll load starts increasing from the set rider roll load $q_0$, i.e., from the spring force 0. By means of pre-compression of the spring, a step-formed increase in the rider roll load is obtained before the rider roll starts rising, which is illustrated by the upper curve of dashed line. In FIG. 5C, the rider roll load corresponding to the pre-compression force of the spring is denoted with the letter $q_0$.

Figure 6:
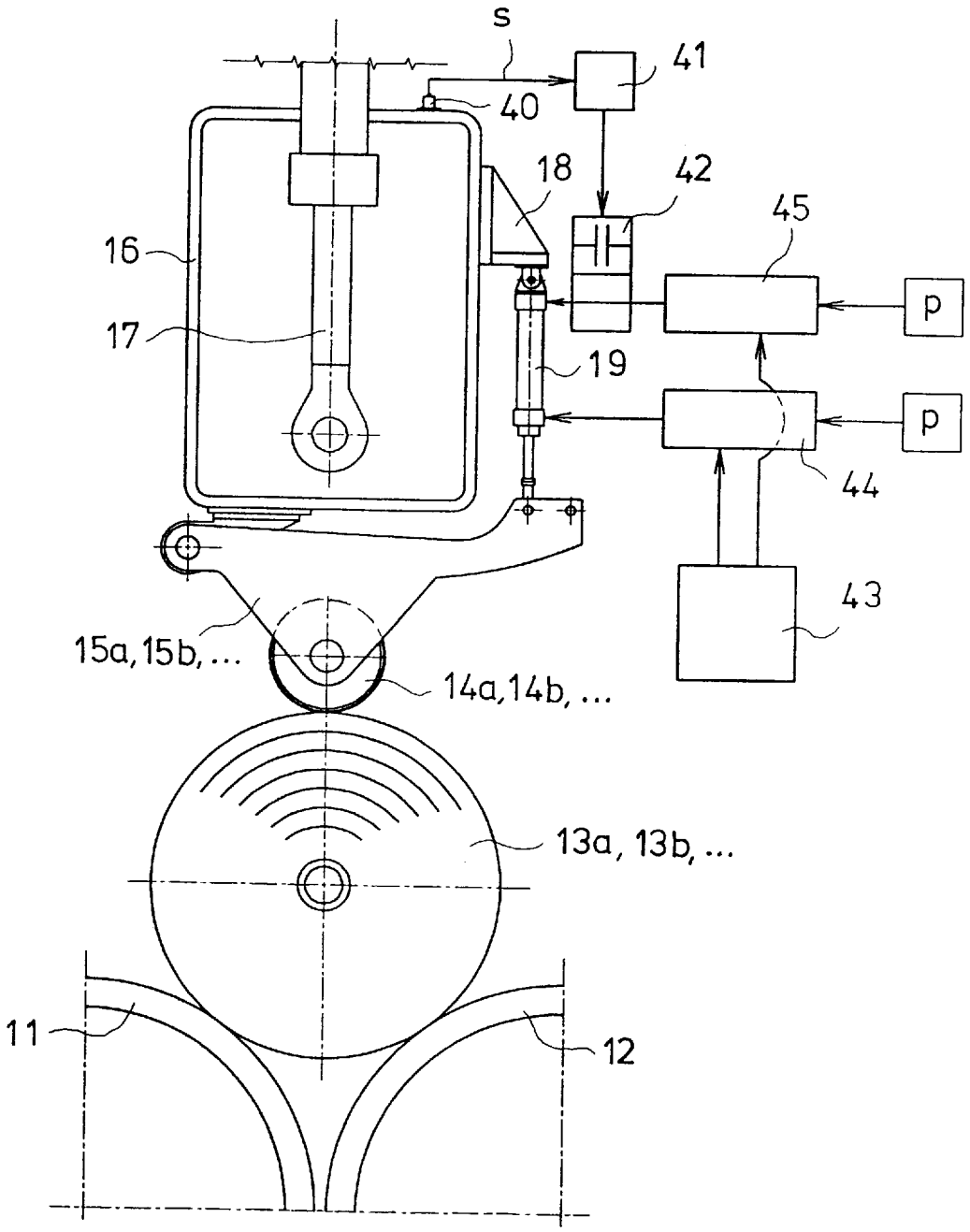
FIG. 6 is a schematic side view of a second preferred embodiment of the method and the device in accordance with the invention.

In the embodiment shown in FIG. 6, the acceleration detector is denoted by reference numeral 40. Reference numeral 43 refers to a regulator which controls the operations of valves 44 and 45 so that the force of the loading cylinder 19, i.e., the cylinder force that determines the rider roll load, during normal winding is at the desired level. The acceleration detector 40 gives signal s to the regulator 41, which controls a valve device 42 so that the valve device 42 locks the hydraulic or pneumatic circuit so that no normal flow takes place, in which case the loading cylinder operates 19 in the way of a rigid piece. In such a case, the operation of the truncated rider roll 100 is similar to that illustrated in FIG. 5B.

By means of an acceleration detector 40, it is, of course, also possible to control other coupling actuators than, for example, a hydraulic valve. Similar "coupling actuators" are, for example, a disk brake and other couplings based on friction. Such coupling actuators can be placed in the same construction with the load regulation actuator, or separately from it.

Above, some preferred embodiments of the invention have been described, and it is obvious to a person skilled in the art that numerous modifications can be made to these embodiments within the scope of the inventive idea defined in the accompanying patent claims. As such, the examples provided above are not meant to be exclusive. Many other variations of the present invention would be obvious to those skilled in the art, and are contemplated to be within the scope of the appended claims.

I claim:

1. A method in winding of a material web in which a plurality of separate web rolls are formed around a respective roll core, the web rolls being arranged one after another and side by side, each web roll being supported by and in contact with support members and loaded by a load produced by at least one rider roll, comprising the steps of:

mounting the at least one rider roll on a rider roll beam, and adjusting the coupling between the at least one rider roll and the rider roll beam in a situation of disturbed winding when the respective web roll separates from the support members in comparison to a normal winding situation when the respective web roll is in contact with the support members such that the at least one rider roll is coupled to the rider roll beam in a first manner during disturbed winding and in a second manner different than said first manner during normal winding so that the at least one rider roll produces a higher load during disturbed winding than during normal winding.

2. The method of claim 1, wherein each of the web rolls is loaded by a load produced by a plurality of rider rolls coupled to the rider roll beam.

3. The method of claim 1, further comprising the steps of:

measuring the acceleration of the rider roll beam, and generating a signal based on the measured acceleration of the rider roll beam, the coupling of the at least one rider roll to the rider roll beam being adjusted based on the signal.

4. The method of claim 3, wherein the acceleration of the rider roll beam is measured in a direction opposite to the direction of the load produced by the at least one rider roll.

5. The method of claim 1, wherein the coupling between the at least one rider roll and the rider roll beam is adjusted based on flow resistance of a fluid, inertia of mass of the at least one rider roll, or the direction of movement of the at least one rider roll.

6. The method of claim 1, wherein the coupling between the at least one rider roll and the rider roll beam is adjusted based on a change in the relative speed of movement between the rider roll beam and the at least one rider roll.

7. A device in winding of a material web in which a plurality of separate web rolls are formed around a respective roll core, the web rolls being arranged one after another and side by side, each web roll being supported by and in contact with support members and loaded by a load produced by at least one rider roll coupled to a rider roll beam, comprising attenuation means for attenuating a disturbed movement of at least one of the web rolls when the at least one web roll separates from the support members, said attenuation means comprising means for adjusting the coupling of the at least one rider roll loading the at least one web roll during the disturbed movement such that the at least one rider roll is coupled to the rider roll beam in a first manner during the disturbed movement and in a second manner different than said first manner during normal winding of the at least one web roll so that the at least one rider roll produces a higher load during the disturbed movement than during normal winding when the respective web roll is in contact with the support members.

8. The device of claim 7, further comprising a fastening bracket connected to the rider roll beam, and a fastening member connected to each of the at least one rider roll, said coupling adjustment means comprise a coupling extending between said fastening bracket and said fastening member connected to each of the at least one rider roll.

9. The device of claim 8, wherein said coupling comprises biasing means fixed to said fastening bracket.

10. The device of claim 9, wherein said biasing means comprise a spring.

11. The device of claim 10, wherein said spring is pre-compressed.

12. The device of claim 8, wherein said coupling comprises means defining an interior compartment receivable of a pressure medium, a piston movable within said interior compartment and at least one narrow flow passage formed in said piston through which the pressure medium is flowable.

13. The device of claim 8, wherein said coupling comprises an outer peripheral wall defining an interior compartment receivable of a pressure medium, a piston movable within said interior compartment and at least one narrow flow passage formed in said peripheral wall and through which the pressure medium is flowable.

14. The device of claim 13, wherein said coupling further comprises a flow passage extending through said peripheral wall for passing the pressure medium into said interior compartment.

15. The device of claim 7, wherein the load of the web rolls is produced by at least one cylinder actuated by a pressure medium, said coupling adjusting means comprising an acceleration detector for detecting acceleration of the rider roll beam and generating a signal representative thereof, means for regulating the flow of the pressure medium to the at least one cylinder, and a regulator for receiving the signal representative of the acceleration of the rider roll beam from said acceleration detector and controlling said regulating means based thereon.

16. The device of claim 15, wherein said regulating means comprise a valve which ceases the flow of pressure medium into the cylinder.

17. The device of claim 15, wherein said acceleration detector is arranged to control a disk brake, a coupling based on friction, or another coupling actuator.

18. The device of claim 7, wherein said coupling adjustment means are structured and arranged to adjust the coupling between the at least one rider roll and the rider roll beam based on a change in the relative speed of movement between the rider roll beam and the at least one rider roll.

19. A method in winding of a material web in which a plurality of separate web rolls are formed around a respective roll core, the web rolls being arranged one after another and side by side, each web roll being supported by and in contact with support members and loaded by a load produced by at least one rider roll, comprising the steps of:

mounting the at least one rider roll on a rider roll beam, measuring the acceleration of the rider roll beam, and generating a signal based on the measured acceleration of the rider roll beam, and adjusting the coupling between the at least one rider roll and the rider roll beam in a situation of disturbed winding when the respective web roll separates from the support members in comparison to a normal winding situation when the respective web roll is in contact with the support members based on the signal such that the load produced by the at least one rider roll is higher during disturbed winding than the load produced by the at least one rider roll during normal winding.

20. The method of claim 19, wherein the acceleration of the rider roll beam is measured in a direction opposite to the direction of the load produced by the at least one rider roll.

21. A device in winding of a material web in which a plurality of separate web rolls are formed around a respective roll core, the web rolls being arranged one after another and side by side, each web roll being supported by and in contact with support members and loaded by a load produced by at least one rider roll coupled to a rider roll beam, comprising attenuation means for attenuating a disturbed movement of at least one of the web rolls when the at least one web roll separates from the support members, said attenuation means comprising coupling adjustment means for adjusting the coupling of the at least one rider roll loading the at least one web roll during the disturbed movement such that the load produced by the at least one rider roll during the disturbed movement is higher than the load produced by the at least one rider roll during normal winding when the respective web roll is in contact with the support members, a fastening bracket connected to the rider roll beam, and a fastening member connected to each of the at least one rider roll, said coupling adjustment means comprise a coupling extending between said fastening bracket and said fastening member connected to each of the at least one rider roll.

22. The device of claim 21, wherein said coupling comprises biasing means fixed to said fastening bracket.

23. The device of claim 21, wherein said coupling comprises means defining an interior compartment receivable of a pressure medium, a piston movable within said interior compartment and at least one narrow flow passage formed in said piston through which the pressure medium is flowable.

24. The device of claim 21, wherein said coupling comprises an outer peripheral wall defining an interior compartment receivable of a pressure medium, a piston movable within said interior compartment and at least one narrow flow passage formed in said peripheral wall and through which the pressure medium is flowable.

25. The device of claim 24, wherein said coupling further comprises a flow passage extending through said peripheral wall for passing the pressure medium into said interior compartment.

26. A device in winding of a material web in which a plurality of separate web rolls are formed around a respective roll core, the web rolls being arranged one after another and side by side, each web roll being supported by and in contact with support members and loaded by a load produced by at least one rider roll coupled to a rider roll beam, comprising attenuation means for attenuating a disturbed movement of at least one of the web rolls when the at least one web roll separates from the support members, said attenuation means comprising coupling adjustment means for adjusting the coupling of the at least one rider roll loading the at least one web roll during the disturbed movement such that the load produced by the at least one rider roll during the disturbed movement is higher than the load produced by the at least one rider roll during normal winding when the respective web roll is in contact with the support members, the load of the web rolls being produced by at least one cylinder actuated by a pressure medium, said coupling adjusting means comprising an acceleration detector for detecting acceleration of the rider roll beam and generating a signal representative thereof, regulating means for regulating the flow of the pressure medium to the at least one cylinder, and a regulator for receiving the signal representative of the acceleration of the rider roll beam from said acceleration detector and controlling said regulating means based thereon.

27. The device of claim 26, wherein said regulating means comprise a valve which ceases the flow of pressure medium into the cylinder.

28. The device of claim 26, wherein said acceleration detector is arranged to control a disk brake, a coupling based on friction, or another coupling actuator.

* * * * *